United States Patent [19]

Fujikawa

[11] Patent Number: 4,706,588

[45] Date of Patent: Nov. 17, 1987

[54] FAST-RELEASE SEWING MACHINE CONTROL DEVICE

[75] Inventor: Katsuhiro Fujikawa, Aichi, Japan

[73] Assignee: Mitsubishi Denki Kabushiki Kaisha, Tokyo, Japan

[21] Appl. No.: 898,164

[22] Filed: Aug. 18, 1986

[30] Foreign Application Priority Data

Aug. 22, 1985 [JP] Japan ..... 60-184906
Aug. 22, 1985 [JP] Japan ..... 60-184907

[51] Int. Cl.[4] ..... D05B 29/02; D05B 69/22

[52] U.S. Cl. ..... 112/239; 112/275; 112/286

[58] Field of Search ..... 112/239, 237, 235, 275, 112/277, 276, 121.11, 453, 285, 286

[56] References Cited

U.S. PATENT DOCUMENTS 4,538,533 9/1985 Ohchi et al. ..... 112/239
4,546,716 10/1985 Babson et al. ..... 112/239 X

FOREIGN PATENT DOCUMENTS 2801456 8/1978 Fed. Rep. of Germany .

*Primary Examiner*—Peter Nerbun
*Attorney, Agent, or Firm*—Sughrue, Mion, Zinn, Macpeak, and Seas

[57] ABSTRACT

In a sewing machine which is so designed that its cloth presser driven to press a material to be sewn for a sewing operation is automatically released when the sewing operation is ended, a sewing machine control device comprising drivers for operating a brake to stop the vertical movement of the needle, for operating the cloth presser, and for operating a thread wiper and a control section. When the needle is moved to its upper position at the final stage of the sewing operation, the control section operates the driver for the thread wiper and restores, after the thread wiper has been restored, the cloth presser. Alternatively, if the thread wiper isn't used, when the needle is moved to the upper position, the control section operates the brake and releases the cloth presser whereby the time which elapses until the cloth presser has been released is shortened.

9 Claims, 6 Drawing Figures

FAST-RELEASE SEWING MACHINE CONTROL DEVICE

BACKGROUND OF THE INVENTION

1. FIELD OF THE INVENTION

This invention relates to a sewing machine control device which automatically releases the cloth presser of a sewing machine.

2. BACKGROUND ART

In general, in a sewing operation with a sewing machine, the thread cutter, the thread wiper and the cloth presser of the sewing machine are restored before a material which has been sewed (hereinafter referred to as "a sewn cloth") is removed from the sewing machine. Most of the industrial sewing machines are so designed that these operations are automatically carried out. That is, the thread cutting operation is carried out while the needle is moved from its upper position to its lower position. Thereafter, in order to stop the movement of the needle when the needle is moved to its upper position, the output shaft of a sewing machine drive motor is braked, while the thread wiping operation is performed. Then, after the brake is released, the cloth presser is restored (returned to its original position) and the sewn cloth is removed from the sewing machine.

In one type of sewing method, when the sewing operation of one piece of cloth is accomplished, another piece of cloth is immediately sewn thereafter. In this sewing method, no thread cutting operation is required. Therefore, some of the sewing machines are so designed as to selectively employ the thread cutting function.

In the case of a conventional control device operating as described above, the cloth presser is released after the needle is completely stopped at the upper position. That is, although the thread cutting operation and the thread wiping operation have been accomplished, the cloth is still pressed, and accordingly the sewn cloth cannot be removed from the sewing machine before the braking operation is accomplished, which makes it difficult to improve the working efficiency.

Even in the case where the thread cutting operation and the thread wiping operation are not required, the removal of the sewn cloth is permitted only after the braking operation is ended, which also makes it difficult to improve the working efficiency.

The working efficiency may be improved by shortening the brake operation time. However, in this case, it may become impossible to completely stop the needle, and the operation of the sewing machine may have safety difficulties.

SUMMARY OF THE INVENTION

An object of this invention is to eliminate the above-described difficulties. More specifically, an object of the invention is to provide a sewing machine control device which can improve the working efficiency.

In order to eliminate the above-described difficulty, a sewing machine control device which is a first embodiment of the invention is so designed that the cloth presser of a sewing machine is released simultaneously when the braking operation is effected. Also, a sewing machine control device which is a second embodiment of the invention is so designed that the cloth presser is released after the thread wiping operation has been accomplished.

Both of the first and second embodiments can decrease the time which elapses until the cloth presser has been released.

DETAILED DESCRIPTION OF THE PREFERRED EMBODIMENTS

A first embodiment of this invention will be described with reference to FIGS. 1 through 3.

Figure 3:
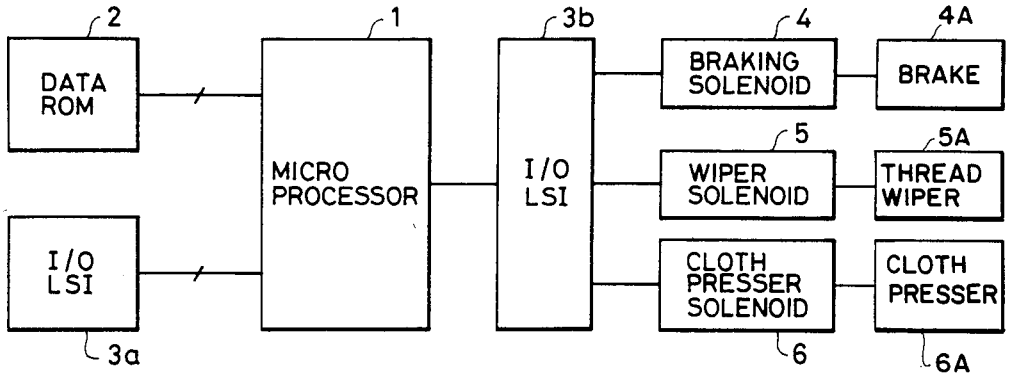
FIG. 3 is a block diagram showing the arrangement of the sewing machine control device.

FIG. 3 is a block diagram showing the first embodiment of the invention. In FIG. 3 are shown a microprocessor 1 and a data ROM 2 in which an operation sequence as shown in FIG. 2 has been writing. LSI integrated circuits 3a and 3b are used for input and output and will hereafter be referred to as "I/O LSIs". A braking solenoid 4 for operating a brake 4a is contained in a driving motor is used for stopping the needle. Also shown are a thread wiper driving solenoid 5 for driving a thread wiper 5A and a cloth presser driving solenoid 6 for operating a cloth presser 6A.

Figure 1:
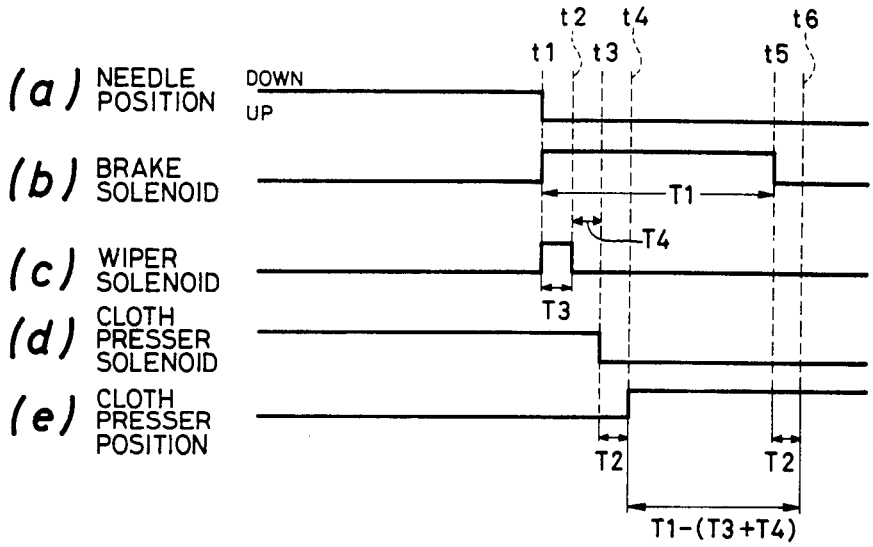
FIG. 1 is a timing diagram for a description of the operation of a sewing machine control device which is a first embodiment of this invention.

FIG. 1 is a timing diagram showing the operation of the sewing machine control device of FIG. 3. More specifically the time chart of FIG. 1 is for a part of the operation in which a sewing operation is finished and the cloth presser is released. When a sewing operation is ended, a signal to stop the operation of the sewing machine is applied through the I/O LSI 3*a* to the microprocessor 1, whereupon the microprocessor 1 reads the operation sequence out of the data ROM 2. Part (a) of FIG. 1 indicates the final needle position. More specifically it indicates the fact that the needle is kept held at its upper position following the time instant $t_1$. At the time instant $t_1$ when the needle is lifted to the upper position, as indicated in part (b) of FIG. 1, the braking solenoid is driven to stop the movement of the needle, so that the needle is held at the upper position. Furthermore, at the time instant $t_1$, as shown in part (c) of FIG. 1, the thread wiper driving solenoid 5 is driven, so that the thread wiper (not shown) is operated for a period T3, and is restored in a period T4.

At the time instant $t_3$ when the wiper is restored, as indicated in part (d) of FIG. 1 the cloth presser driving solenoid 6 is released. Therefore, a period T2 after the time instant $t_3$, i.e., at the time instant $t_4$, the cloth presser is restored as indicated in part (e) of FIG. 1. Therefore, after the time instant $t_4$ the sewn cloth can be removed from the sewing machine. When a period T1 passes from the time instant $t_1$, the inertia of the needle driving mechanism has been sufficiently absorbed and the needle has been completely stopped. Therefore, at the time instant $t_5$ the braking solenoid 4 for the needle is released.

In the case of the conventional sewing machine control device, after the period T1, required for releasing the braking solenoid 4, passes from the time instant $t_1$ when the needle is stopped, the cloth presser driving solenoid 6 is released, and therefore after the cloth presser is restored the sewn cloth can be removed from the sewing machine at the time instant $t_6$ which occurs following the period T2 after the period T1, as is apparent from FIG. 1. On the other hand, in the case of the sewing machine control device of the invention, at the time instant $t_4$ the cloth presser is restored, and therefore the sewn cloth can be taken out. Accordingly, in the case of the sewing machine control device of the invention the sewn cloth can be removed from the sewing machine at a time (T1−(T3+T4)) earlier than in the case of the conventional sewing machine.

Figure 2:
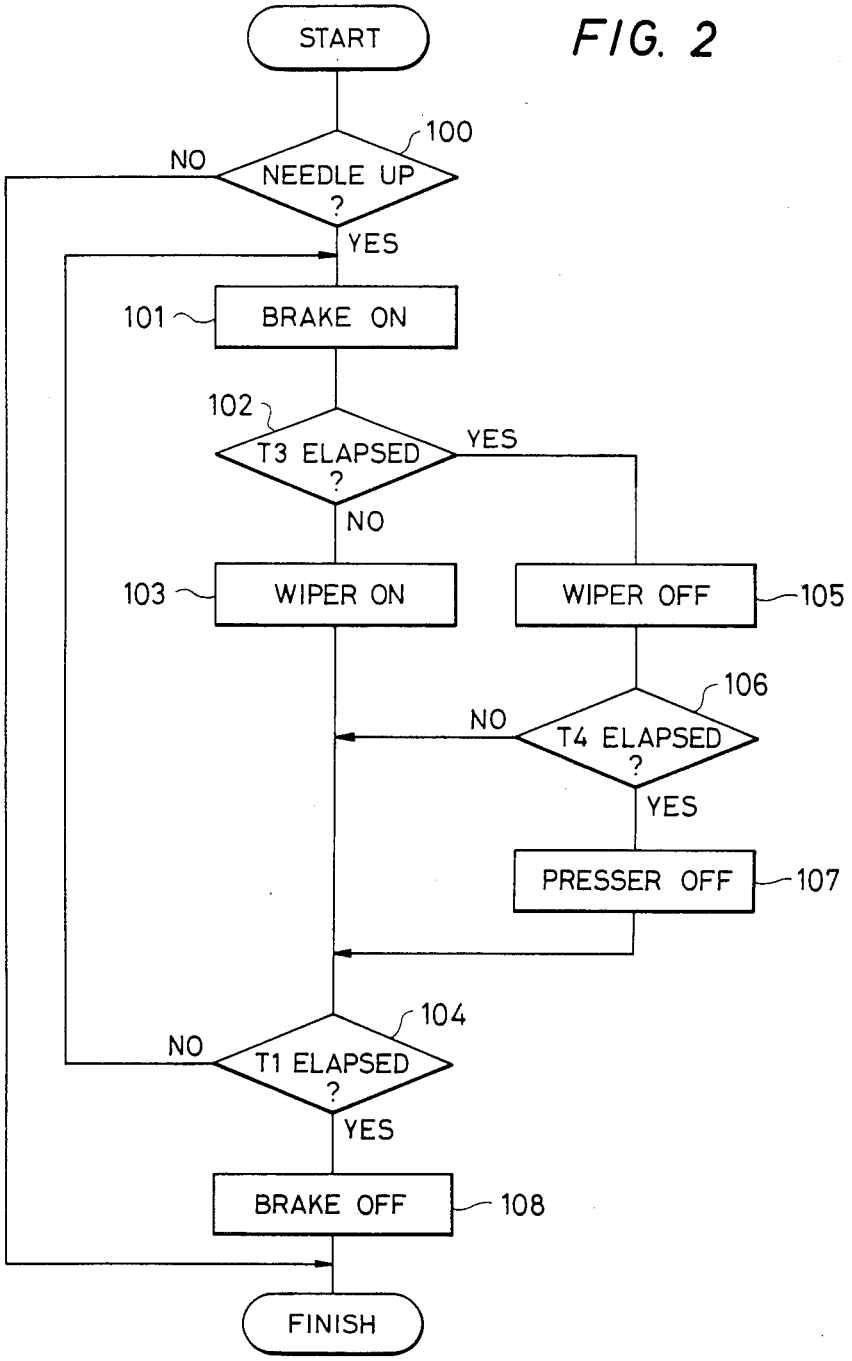
FIG. 2 is a flow chart of a program for performing operations indicated in FIG. 1.

FIG. 2 is a flow chart of a program executing the above-described operation. As shown in FIG. 2, in Step 100 it is determined whether or not the needle is at the upper position. The determination is made immediately before the needle is stopped. If it is determined that the needle is at the upper position, i.e., the result of the determination is positive or "YES", then in Step 101 a "BRAKE ON" operation is carried out, and in Step 102 it is determined whether or not the wiper operation time T3 has passed from the time $t_1$ of raising the needle.

Before the period T3 has passed, the result of the determination in Step 102 is negative or "NO", and therefore in Step 103 a "WIPER ON" operation, i.e., a thread wiping operation is carried out. Then, in Step 104 it is determined whether or not the brake operation period T1 has passed. In at least the initial pass through the loop, the result of the determination in Step 104 is "NO", and therefore Step 101 is effected again, so that Steps 101 through 104 are repetitively performed. When the wiper operation period T3 has passed, in Step 102 the result of the determination is "YES". Therefore, in Step 105 a "WIPER OFF" operation is carried out, and in Step 106 it is determined whether or not the wiper restoring period T4 has passed since the end of the wiper operation period T3. As long as the determination of Step 106 provides the negative result, Steps 101, 102, 105, 106 and 104 are repetitively carried out. However, when in Step 106 the determination provides the positive result that the wiper restoring period has elapsed, in Step 107 a "PRESSER OFF" operation is carried out.

Thereafter when in Step 104 the determination provides the positive result, i.e., it is determined that the brake operation time T1 has passed, in Step 108 a "BRAKE OFF" operation is carried out. In the case where in Step 100 the result of the determination is "NO", i.e., the needle is not at the upper position, the above-described various operations are not performed.

It should be noted that FIG. 2 indicates the final stage of the sewing operation. If the sewing operation is carried out again, then the operations of FIG. 2 are performed again at the final stage of that sewing operation.

As is apparent from the above description, in the first embodiment of the invention, the cloth presser is released after the thread wiping operation, and therefore the time which elapses until the sewn cloth is removed from the sewing machine is shortened and the working efficiency is improved when compared with the conventional sewing machine control device in which the cloth presser is restored after the brake operation time.

A second embodiment of the invention will be described with reference to FIGS. 4 through 6. The entire arrangement of the second embodiment of the invention is similar to that of the above-described first embodiment of FIG. 3. That is, a sewing machine control device, the second embodiment of the invention, comprises as shown in FIG. 3 a microprocessor 1, a data ROM 2, I/O LSIs 3*a* and 3*b*, a brake driving solenoid 4, a thread wiper driving solenoid 5, and a cloth presser driving solenoid 6.

Figure 4:
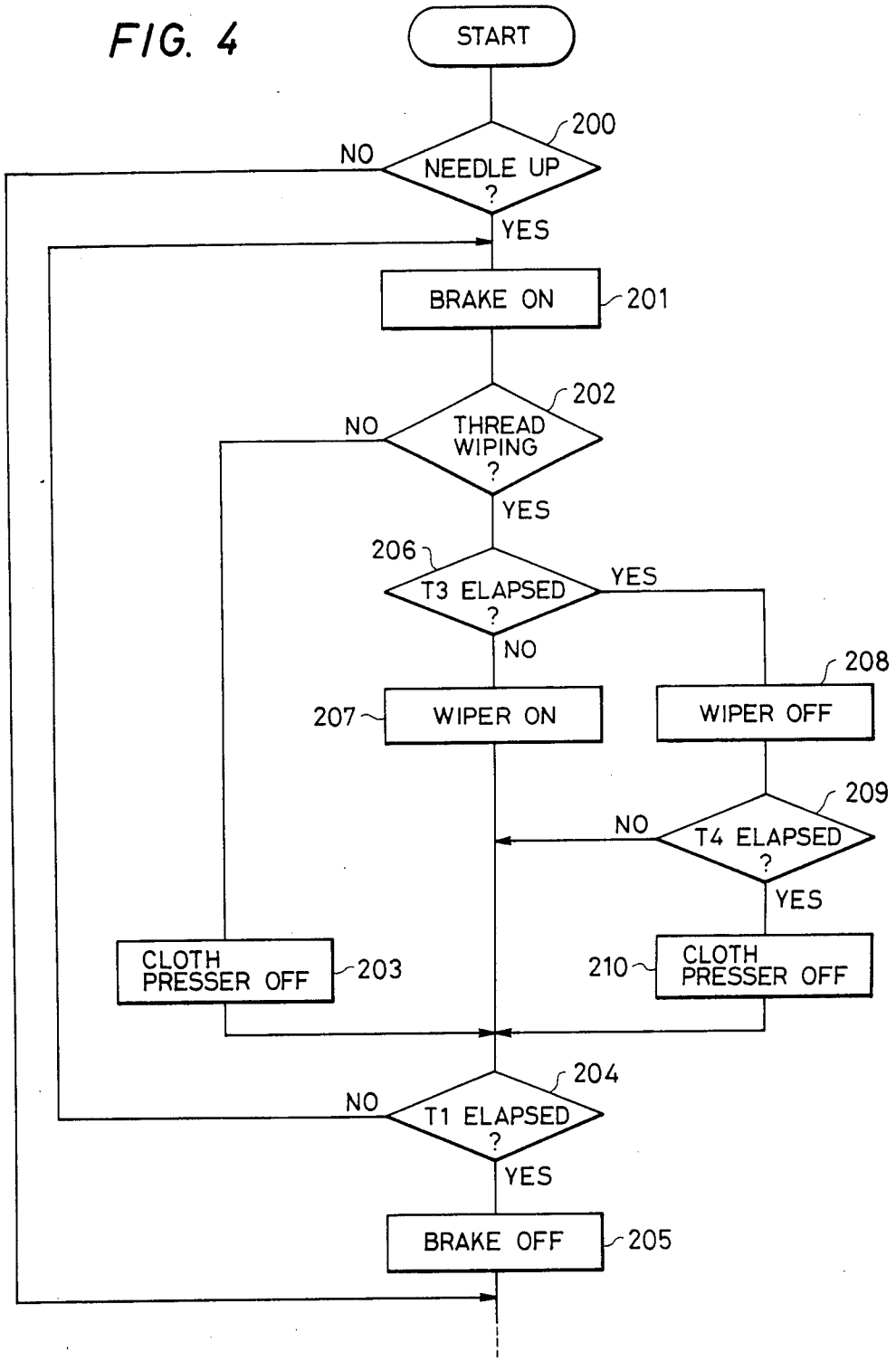
FIG. 4 is a flow chart for describing a sewing machine control in accordance with a second embodiment of the invention.

The operation sequence of the data ROM 2 is as indicated in FIG. 4, which is somewhat different from that of FIG. 2.

Figure 5:
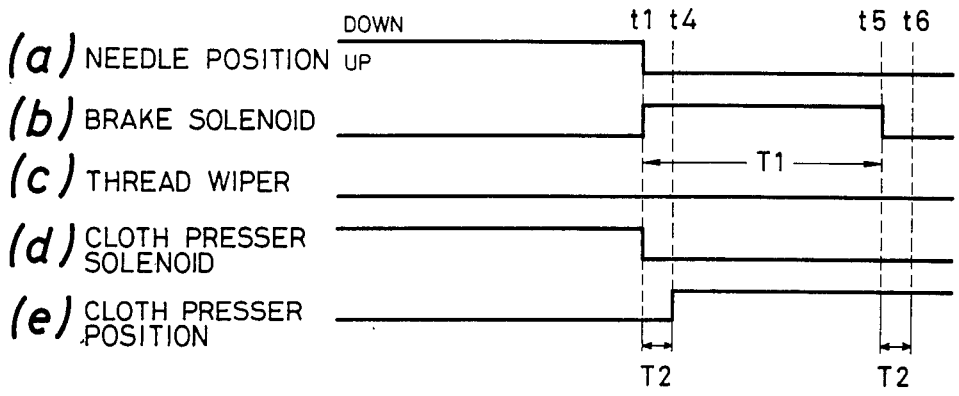
FIGS. 5 and 6 are timing diagrams for a description of the operation of the sewing machine control device based on the flow chart of FIG. 4.

FIG. 5 is a time chart indicating the operation of the control device in the case where the thread cutting operation and the thread wiping operation are not carried out. That is, the time chart of FIG. 5 is for the releasing of the cloth presser after a sewing operation. Upon completion of a sewing operation, a signal to stop the operation of the sewing machine is applied through the I/O LSI 3*a* to the microprocessor 1, so that the microprocessor 1 reads the operation sequence from the data ROM 2 and operations as indicated in FIG. 4 are carried out. Part (a) of FIG. 5 shows the final needle position, indicating that the needle is held at the upper position from the time instand $t_1$ onwards. At the time instant $t_1$ when the needle is lifted to the upper position, as indicated in part (b) of FIG. 5, the braking solenoid 4 is driven to stop the movement of the needle, so that the needle is positively held at the upper position.

At the time instant $t_1$ when the braking solenoid 4 is driven, as indicated in part (d) of FIG. 5, the cloth presser driving solenoid is released. Therefore, at the time instant $t_4$ which occurs within a period T2 after the time instant $t_1$, the cloth pressure is restored as indicated in part (e) of FIG. 5. Therefore, the sewn cloth can be removed from the sewing machine at any time from the time instant $t_4$ onwards. When a period T1 passes from the time instant $t_1$ of the raising of the needle, the inertia of the needle driving mechanism has been sufficiently absorbed, i.e., the needle driving mechanism has been stopped, and therefore at the time instant $t_5$ the braking solenoid 4 is released.

In the case of the conventional sewing machine control device, after the period T1 required for releasing the braking solenoid 4 passes from the time instant $t_1$ when the needle was stopped, the cloth presser driving solenoid is released. Therefore, after the cloth presser is restored, the sewn cloth can be removed from the sewing machine at the time instant $t_6$ which occurs after the period T2 following the period T1. On the other hand, in the case of the sewing machine control device of the invention, at the time instant $t_4$ the cloth presser is restored, and therefore the sewn cloth can be removed from the sewing machine. Accordingly, in the case of the sewing machine control device of the invention, the sewn cloth can be removed from the sewing machine at a time which is a period T1 earlier than in the case of the conventional sewing machine. Part (c) of FIG. 5 indicates the operation timing of the thread wiper driving solenoid. However, in this case, the thread wiper driving solenoid is not driven because the thread wiping operation is not carried out.

Figure 6:
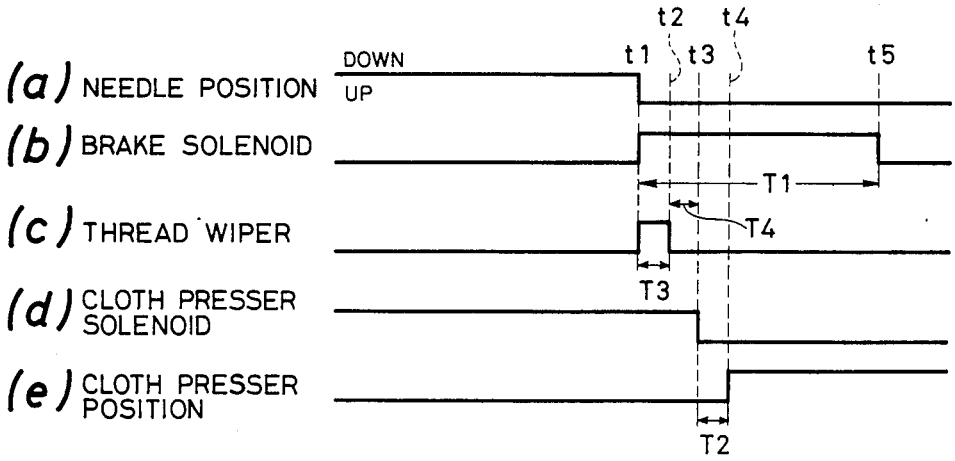

FIG. 6 is a time chart for the case where the thread wiping operation is carried out. The time chart of FIG. 6 is different from that of FIG. 5 only in that, after the thread wiper operation time T3 and the thread wiper restoring time T4 (part (c) of FIG. 6) have passed, i.e., after the thread wiping operation has been accomplished, the cloth passer driving solenoid 6 is released as indicated in the part (d) of FIG. 6.

FIG. 4 is a flow chart of a program executing the above-described operations. As shown in FIG. 4, in Step 200 it is determined whether or not the needle is at the upper position. The determination is made immediately before the needle is stopped. It is determined that the needle is at the upper position, that is, the result of the determination is positive or "YES", then in Step 201 a "BRAKE ON" operation is carried out, and in Step 202 it is determined whether or not the thread wiping operation is to be carried out. If in Step 202 the result of the determination is negative or "NO", that is, in the case when the thread wiping operation is not to be performed, in Step 203 a "CLOTH PRESSER OFF" operation is carried out, and in Step 204 it is determined whether or not the brake operation time T1 has passed. However, in at least the initial pass through the loop, the result of the determination in Step 204 is negative, and therefore Step 201 is performed again, and Steps 201 through 204 are repetitively performed. When the brake operation time T1 has passed, in Step 205 a "BRAKE OFF" operation is carried out.

In the case when in Step 202 the result of the determination is "YES", i.e., the thread wiping operation is to be carried out, in Step 206 it is determined whether or not the wiper operation time T3 had passed.

The result of the determination in Step 206 is "NO" until the time T3 has passed. Therefore in Step 207 a "WIPER ON" operation is carried out. In other words, the thread wiping operation is carried out. In Step 204 it is determined whether or not the brake operation time T1 has passed. However, in the initial loop, the result of the determination in Step 204 is "NO", and therefore Step 201 is performed again, as a result of which Steps 201 through 204 are repeated. When the wiper operation time T3 has passed, the determination in Step 206 provides a positive result of "YES". Therefore, in Step 208 a "WIPER OFF" operation is performed, and in Step 209 it is determined whether or not the wiper restoring time T4 has passed. As long as the determination in Step 209 provides a negative result or "NO", Steps 201, 202, 206, 208, 209 and 204 are cyclically repeated. When in Step 209 the determination provides a positive result or "YES", in Step 210 the "PRESSER OFF" operation is carried out. Thereafter, when in Step 204 the result of the determination is "YES"; i.e., it is determined that the brake operation time T1 has passed, a "BRAKE OFF" operation is carried out in Step 205.

When in Step 200 the result of the determination is "NO", i.e., the needle is not at the upper position, the above-described operations are not carried out.

It should be noted that FIG. 4 indicates the final stage of the sewing operation. If the sewing operation is carried out again, then the operations of FIG. 4 are performed again at the final stage of that sewing operation.

As is apparent from the above-description, in the second embodiment of the invention, the cloth presser is released simultaneously when the brake operation is effected, and therefore the time which elapses until the sewn cloth is removed from sewing machine is shortened and the working efficiency is improved when compared with the conventional sewing machine control device in which the cloth presser is restored after the brake operation time has passed.

As is apparent from the above description, the time which elapses until the cloth presser is released is shortened according to the invention. Therefore, if the sewing machine control device of the invention is used, the timing of removing the sewn cloth from the sewing machine can be made earlier than that of the conventional sewing machine. That is, with this sewing machine control device, the working efficiency can be improved.

I claim:

1. A sewing machine control device comprising:
cloth presser driving means for operating a cloth presser adapted to press a material to be sewn;
brake driving means for operating a brake adapted to stop a vertical movement of a needle; and
control means, operable when said needle is lifted to an upper position thereof at a final stage of a sewing operation for operating said brake driving means for a braking period and for releasing said cloth presser driving means during said braking period wherein the sewn material may be removed from the machine before said braking period is ended.

2. A sewing machine control device as recited in claim 1:
further comprising thread wiping means; and
wherein said control means operates said thread wiping means substantially immediately following the beginning of operating said brake driving means and delays releasing said presser driving means for a thread wiping period.

3. A sewing machine control device as recited in claim 2, wherein said control means selectively both operates said thread wiping means and delays releasing said cloth presser means.

4. A sewing machine control device as recited in claim 1, wherein said control means releases said cloth presser driving means substantially immediately following the beginning of operating said brake driving means.

5. A sewing machine control device as claimed in claim 1, in which said brake driving means and said cloth presser driving means comprise solenoids.

6. A sewing machine control device comprising:
cloth presser driving means for operating a cloth presser adapted to press a material to be sewn;
brake driving means for operating a brake adapted to stop the vertical movement of a needle;
thread wiper driving means for driving a thread wiper; and
control means for driving said cloth presser driving means for a sewing operation, for operating, when said needle is lifted to an upper position thereof at the final stage of said sewing operation, said thread wiper driving means for a first predetermined period of time and said brake driving means for a second predetermined period of time longer than said first predetermined period of time, and for releasing, when said thread wiper is restored, said cloth presser driving means to permit the sewn material to be removed from the machine before the braking period is ended.

7. A sewing machine control device as claimed in claim 6, wherein said control means begins operating said thread wiper driving means and said brake driving means substantially simultaneously.

8. A sewing machine control device as recited in claim 6, wherein said control means selectively operates said thread wiper driving means and, if said thread wiper driving means are not selectively operated, said control means releases said cloth presser driving means when said needle is lifted to said upper position thereof at the final stage of said sewing operation.

9. A sewing machine control device as claimed in claim 7, in which said cloth presser driving means, said thread wiper driving means and said brake driving means comprise solenoids.

* * * * *